US006245837B1

(12) United States Patent
Cassel et al.

(10) Patent No.: US 6,245,837 B1
(45) Date of Patent: Jun. 12, 2001

(54) USE OF A LINEAR SYNTHETIC POLYMER TO IMPROVE THE PROPERTIES OF A CELLULOSE SHAPED BODY DERIVED FROM A TERTIARY AMINE OXIDE PROCESS

(75) Inventors: Anders Cassel, Myggenas (SE); Bogumil Laszkiewicz, Lodz (PL); Zbigniew Lewandowski, Lodz (PL); Barbara Niekraszewicz, Lodz (PL); Piotr Kulpinski, Lodz (PL)

(73) Assignee: Akzo Nobel Surface Chemistry AB (SE)

( * ) Notice: Subject to any disclaimer, the term of this patent is extended or adjusted under 35 U.S.C. 154(b) by 0 days.

(21) Appl. No.: 09/249,148

(22) Filed: Feb. 12, 1999

Related U.S. Application Data

(63) Continuation of application No. PCT/SE97/01326, filed on Aug. 6, 1997.

(30) Foreign Application Priority Data

Aug. 27, 1996 (SE) ..... 9603107

(51) Int. Cl.[7] ..... C08J 5/10; C08L 1/00
(52) U.S. Cl. ..... 524/35; 524/36; 524/37
(58) Field of Search ..... 524/476, 477, 524/502, 35, 40, 733, 36, 37

(56) References Cited

U.S. PATENT DOCUMENTS

| | | | | |
|---|---|---|---|---|
| 3,447,939 | | 6/1969 | Johnson | 106/135 |
| 3,447,956 | | 6/1969 | Johnson | 117/154 |
| 4,036,587 | * | 7/1977 | Wolf et al. | 8/92 |
| 4,211,574 | | 7/1980 | McCorsley, III et al. | 106/163 R |
| 4,246,221 | | 1/1981 | McCorsley, III | 264/203 |
| 4,851,522 | | 7/1989 | Chanzy et al. | 536/56 |
| 5,047,197 | | 9/1991 | Uneback et al. | 264/193 |
| 5,792,399 | | 8/1998 | Meister et al. | 264/101 |
| 5,827,463 | | 10/1998 | Ruf | 264/187 |

FOREIGN PATENT DOCUMENTS

| | | | | |
|---|---|---|---|---|
| 218 121 | | 10/1983 | (DE) | D01F/2/02 |
| WO 92/07124 | * | 4/1992 | (WO) . | |

OTHER PUBLICATIONS

International Search Report, dated Dec. 8, 1997.

* cited by examiner

*Primary Examiner*—James J. Seidleck
*Assistant Examiner*—U. K. Rajguru
(74) *Attorney, Agent, or Firm*—Ralph J. Mancini

(57) ABSTRACT

The present invention relates to the use of a linear synthetic polymer having a molecular weight of from $5 \cdot 10^3$ to $1 \cdot 10^7$ to improve the strength, to reduce the fibrillation tendancy and to regulate the water absorption properties of a cellulose shaped body, derived from a dissolution of cellulose in a tertiary amine oxide. The linear synthetic polymer may be a polyalkylene, a polyalkylene glycol or a polyacrylate or polymetacrylate or its copolymers with other monomers.

11 Claims, No Drawings

USE OF A LINEAR SYNTHETIC POLYMER TO IMPROVE THE PROPERTIES OF A CELLULOSE SHAPED BODY DERIVED FROM A TERTIARY AMINE OXIDE PROCESS

This is a continuation of International application No. PCT/SE97/01326 which was filed on Aug. 6, 1997.

FIELD OF THE INVENTION

The present invention relates to the use of a linear synthetic polymer having a molecular weight of from $5 \cdot 10^3$ to $1 \cdot 10^7$ to improve the strength and elongation, to reduce the fibrillation and to regulate the water absorption properties of a cellulose shaped body, derived from a dissolution of cellulose in a tertiary amine oxide. The linear synthetic polymer is preferably a polyethylene, a polyethylene glycol, a polyacrylate, a polymetacrylate or a copolymer between an acrylate or a metacrylate and another monomer.

BACKGROUND OF THE INVENTION

It is well-known to produce cellulose fibers and other formed products by preparing cellulose solutions in tertiary amine oxides, like N-methyl morpholine-N-oxide (NMMO), optionally containing minor amount of water, extruding the cellulose solutions through spinnerets and coagulating the fibers formed in an aqueous bath followed by at least one washing bath. See for example the U.S. Pat. Nos. 3,447,939, 3,447,956 and 4,211,574.

In AT 401 063 B, it has also been suggested to use non-aqueous fluids in the bath. The cellulose used in these processes has usually a polymerisation degree of not lower than 200 and preferably not lower than 400. The cellulose fibers manufactured from the cellulose-NMMO system according to the above mentioned system normally exhibit a tensile strength of about 15 cN/tex and an elongation at break of about 4–8%. The cellulose fibers intended for clothing purposes must have considerably higher levels of elongation at break, namely over 10% combined with an improved tensile strength. Another disadvantage of cellulose fibers produced by the NMMO system is the too high tendency to fibrilate and to form small balls on the fabric surface, which is also known as pilling.

Furthermore, in the Patent Publication DD-A1-218 121, it has been observed that air gap between the spinneret and the coagulation bath may be reduced if a polyethylene glycol having a molecular weight of 1000 is present in a NMMO cellulose solution.

U.S. Pat. No. 5,047,197 suggests to add a polyethylene glycol having a molecular weight of from about 1.1 milion to about 4.5 milion to a cellulose dissolved in a tertiary amine oxide to improve the flow rate through a spinning nozzle.

WO 96/14451 discloses the use of a polyalkylene imine derivate to stabilize a shaped body derived from cellulose regenerated by the amino-oxide process and WO 86/05526 discloses the possibility to add a number of polymers to a dissolution of lignocellulose materials in a tertiary amino oxide. Thus, none of these references presents a solution of the disadvantages earlier mentioned.

U.S. Pat. No 4,246,221 discloses a NMMO process for the manufacture of cellulose fibers with improved strength. However, the application of the fibers in fabric industry is rather limited due to their wet fibrillation tendency.

Therefore, one object of the present invention is to essentially improve the general properties, like dry strength, wet strength, elongation and to reduce the fibrillation of a cellulose shaped product produced by a tertiary amine oxide process in order to make the fibers more useful, e.g. for textile fabrics.

Another object of the invention is to be able to regulate and to control the water absorption properties of the product, such as retention, absorbed water amounts, and absorption speed.

These and other objects have been met by the method of the present invention.

SUMMARY OF THE INVENTION

The present invention relates to the use of a linear synthetic polymer having a molecular weight of from $5 \cdot 10^3$ to $1 \cdot 10^7$ to improve the strength and elongation, to reduce the fibrillation and to regulate the water absorption properties of a cellulose shaped body, such as a fiber, derived from a dissolution of cellulose in a tertiary amine oxide. The linear synthetic polymer is preferably a polyethylene, a polyethylene glycol, a polyacrylate, a polymetacrylate or a copolymer between an acrylate or a metacrylate and another monomer.

DETAILED DESCRIPTION OF THE INVENTION

According to the present invention, it has been found that the above mentioned objects are achieved by using a linear synthetic polymer having a molecular weight of from $5 \cdot 10^3$ to $1 \cdot 10^7$, preferably from $1 \cdot 10^4$ to $1 \cdot 10^6$, in a shaped body, obtained by dissolving the cellulose and the synthetic polymer in a tertiary amine oxide, like NMMO, optionally containing up to 20% water based on the amount of the tertiry amine at a. temperature from 70° C. to 130° C., preferably from 80° C. to 120° C., forming a shaped body of the dissolution and coagulating the shaped body in at least one bath under the removal of the tertiary amine oxide. The formation of the shaped body is performed in a conventional manner, for example by extruding the dissolution through a spinneret. In addition to the polymers, modifiers utilized in the production of viscose fibers and cellulose fibers from the tertiary amine oxide process, such as cationic, anionic, nonionic and amphoteric surfactants; complexing agents; and solubilizers, like polyethylene glycols with molecular weight below 1 000; may be present in the dissolution of the polymers or in the coagulation bath. The amounts of modifiers in the dissolution are usually from 0.2 to 5% by weight of the dissolution and from 50 to 1 000 ppm of the bath. The fluid in the coagulation bath is usually a water solution, but other fluids, for e.g., polyethylene glycol, may be used.

The incorporation of the synthetic linear polymer with the cellulose results in a composite product with unexpected positive effects. Thus, the ability of the new products to fibrilate is essentially decreased, while the tensile strength and the elongation at break are essentially increased. Suitable synthetic polymers to be used in the present invention are polyalkylene, such as polyethylene and copolymers of ethylene and propylene; polyalkylene glycols, such as polyethylene glycols, polypropylene glycols and polyalkylene glycols, where the alkylene groups are a mixture of at least two different alkylene groups containing 2, 3 or 4 carbon atoms, preferably 2 and 3 carbon atoms; polyacrylates and polymetacrylates and the copolymers of acrylates or metacrylates with other monomers, such as a copolymer between acrylic acids and acrylamides.

In order to obtain the desired properties it is essential that the polymer weight and the structure of the polymer make it possible to dissolve the polymer under the condition earlier mentioned. By dissolving it is here understood that the liquid formed may have the form of a true solution, a microemulsion or a homogeneous emulsion. The polyalkylenes and other copolymers, which are not directly soluble in the tertiary amine oxide cellulose solutions of the present invention, have to be in liquid form at a temperature below 130° C.

The polyalkylenes are preferably polyethylenes and have molecular weights from $1 \cdot 10^4$ to $1 \cdot 10^5$. The polyalkylene glycols preferably have a molecular weight of from $1 \cdot 10^4$ to $5 \cdot 10^5$, and most preferably from $3 \cdot 10^4$ to $2 \cdot 10^5$. The polyacrylates or polymetacrylates or copolymers of acrylates or metacrylates with other monomers preferably have a molecular weight of from $1 \cdot 10^4$ to $1 \cdot 10^6$ and most preferably from $4 \cdot 10^4$ to $5 \cdot 10^5$. The molecular weight of the cellulose is usually from $5 \cdot 10^4$ to $2 \cdot 10^5$, preferably from $7 \cdot 10^4$ to $1.5 \cdot 10^5$.

The present invention also compasses a cellulose shaped body, such as a fiber, derived from a dissolution of cellulose in a tertiary amine oxide, characterized in, that it contains a) a cellulose and b) based on the weight of the cellulose, from 0.2–20% by weight of a linear synthetic polymer selected from the group consisting of a polyalkylene having a molecular weight of from $5 \cdot 10^3$ to $1 \cdot 10^7$; a polyalkylene glycol having a molecular weight of from $3 \cdot 10^4$ to $2 \cdot 10^5$; and a polyacrylate or a polymetacrylate or a copolymer between an acrylate or a metacrylate and another momomer having a molecular weight of from $5 \cdot 10^3$ to $1 \cdot 10^7$. Suitably the synthetic polymer is a polyethylene with a molecular weight of from $5 \cdot 10^4$ to $2 \cdot 10^5$ or a copolymer between an acrylic acid and an acrylamide, the copolymer having a molecular weight of from $4 \cdot 10^4$ to $5 \cdot 10^5$. The polyalkylene glycol is suitably a polyethylene glycol.

The present invention is further illustrated by the following working examples.

Example 1

An amount of 15 parts by weight of a spruce cellulose (DP 700) was dissolved in 71.5 parts by weight of NMMO and 13.5 parts by weight of water together with an acrylicacrylamide copolymer (MW 120 000) in the amounts stated in Table 1. Fibers were formed by extruding the dissolution at 115° C. through a spinneret with orifices of 160 $\mu$m in diameter and a length/diameter ratio of 4:1. The distance between the spinneret and the coagulation bath was 20 mm and the temperature in the bath was 20° C. The process was conducted with a take-up speed of 45 m/min and 15-fold total drawing ratio. The linear density of the fibers were 3 dtex. The coagulated fibers were washed thoroughly with water to remove remaining NMMO solvent and then dried. Their physical and mechanical properties, such as strength, water absorption, water retention, elongation and fibrillation degree were determined. Fibrillation degree was determined by use of microscopic method described in Chemiefasern Textilind. 43(95), 876(1993).

The following results were obtained.

TABLE 1

| | | Fiber properties | | | | |
|---|---|---|---|---|---|---|
| Example | % Copolymer by weight cellulose | Strength cN/tex | Elongation % | Fibrillation degree | Water absorption % | Retention % |
| 1 | — | 16.5 | 4.2 | 6.0 | 14.4 | 86.8 |
| 2 | 1% | 18.2 | 9.5 | 5.2 | 14.3 | 94.6 |
| 3 | 3% | 20.7 | 9.2 | 4.1 | 14.4 | 96.6 |
| 4 | 5% | 28.9 | 10.5 | 4.3 | 14.5 | 95.8 |

The cellulose fibers containing a minor amount of the copolymer have in comparison with the prior art cellulose fiber a high strength, high elongation and reduced fibrillation. Although the water absorption is about equal between the different fibers the retention is unexpectedly increased for the fiber according to the present invention.

Example 2

The process described in Example 1 was repeated but the copolymer was replaced by 3% or 5% by weight of a polyethylene glycol having a molecular weight of 53 000. A number of physical and mechanical properties of the fibers obtained was determined. The following results were obtained.

TABLE 2

| | | Fiber properties | | | | |
|---|---|---|---|---|---|---|
| Example | % polyethylene glycol by weight of cellulose | Strength cN/tex | Elongation % | Wet strength cN/tex | Fibrillation degree | Retention % |
| 1 | 3 | 23.2 | 11.4 | 17.4 | 4.3 | 98.3 |
| 2 | 5 | 24.0 | 11.1 | 19.4 | 3.8 | 120.6 |
| 3 | — | 16.5 | 4.2 | 14.2 | 6.0 | 86.8 |

From the results it is evident that properties like strength, elongation, fibrillation degree is essentially improved by the presence of the synthetic polymer. The improvment in reducing the fibrillation degree is also important. Moreover, the retention of water is increased, which depends on the incorporation of the hydrophilic polyethylene glycol polymer.

Examiple 3

The process described in Example 1 was repeated but the copolymer was replaced by a low molecular weight of polyethylene (MW 48 000) with a flow temperature of about 100 to 105° C. The physical and mechanical properties of the fibers obtained were determined.

The following results were obtained.

TABLE 3

| | | Fiber properties | | | |
|---|---|---|---|---|---|
| Example | % Polyethylene by weight of cellulose | Strength cN/tex | Elongation % | Fibrillation degree | Retention % |
| 1 | — | 16.5 | 4.2 | 6.0 | 86.8 |
| 2 | 1 | 27.5 | 11.8 | 4.6 | 76.4 |

TABLE 3-continued

| Example | % Polyethylene by weight of cellulose | Fiber properties | | | |
|---|---|---|---|---|---|
| | | Strength cN/tex | Elongation % | Fibrillation degree | Retention % |
| 3 | 3 | 21.2 | 10.6 | 3.8 | 72.1 |
| 4 | 5 | 25.6 | 8.4 | 3.2 | 68.9 |

From the results it is evident that presence of polyene has a remarkable positive effect on properties like strength, elongation and fibrillation. Moreover, the retention of water is lowered by the incorporation of the hydrophobic polyethylene polymer.

We claim:

1. A process for preparing a cellulose shaped body with improved strength, elongation, water absorption properties and reduced fibrillation, said process comprising dissolving a cellulose and a synthetic polymer having a molecular weight of from $5 \cdot 10^3$ to $1 \cdot 10^7$ selected from the group consisting of polyalkylene, polyacrylate, polymethacrylate, a copolymer of an acrylate or a methacrylate and another monomer having a molecular weight of from $5 \cdot 10^3$ to $1 \cdot 10^7$ and a polyalkylene glycol having a molecular weight of $1 \cdot 10^4$ to $5 \cdot 10^5$, in a tertiary amine oxide forming a solution, said solution containing up to 20% water based on the amount of the tertiary amine oxide, at a temperature from 70 to 130° C., forming a shaped body from the solution and coagulating the shaped body in at least one bath under the removal of the tertiary amine oxide.

2. The process of claim 1 wherein the linear synthetic polymer is a polyalkylene with a molecular weight of from $1 \cdot 10^4$ to $1 \cdot 10^6$.

3. The process of claim 2 wherein the polyalkylene is a polyethylene with a molecular weight of from $5 \cdot 10^4$ to $2 \cdot 10^5$.

4. The process of claim 1 wherein the polyalkylene glycol has a molecular weight of from $3 \cdot 10^4$ to $2 \cdot 10^5$.

5. The process of claim 1 wherein the linear synthetic polymer is selected from the group consisting of polyacrylate, polymettacrylate, a copolymer of an acrylate, or a methacrylate and another monomer and mixtures thereof and said polymer has a molecular weight of from $1 \cdot 10^4$ to $1 \cdot 10^6$.

6. The process of claim 6 wherein the synthetic polymer is a copolymer of an acrylic acid and an acrylamide.

7. The process of claim 1 wherein the tertiary amine oxide is N-methylmorpholine-N-oxide.

8. A cellulose shaped body derived from a solution of cellulose in a tertiary amine oxide, wherein said solution contains a) a cellulose and b) from 0.2–20% by weight, based on the weight of the cellulose, of a linear synthetic polymer selected from the group consisting of a polyalkylene having a molecular weight of from $5 \cdot 10^3$ to $1 \cdot 10^7$; a polyalkylene glycol having a weight average molecular weight of from $3 \cdot 10^4$ to $2 \cdot 10^5$; a polyacrylate; a polymethacrylate; a copolymer of an acrylate or a methacrylate and another momomer having a molecular weight of from $5 \cdot 10^3$ to $1 \cdot 10^7$; and mixtures thereof.

9. The shaped body of claim 9 wherein the linear synthetic polymer is a polyethylene having a molecular weight of from $5 \cdot 10^4$ to $2 \cdot 10^5$.

10. The shaped body of claim 8 wherein the linear synthetic polymer is a copolymer between an acrylic acid and an acrylamide, the copolymer having a molecular weight of from $4 \cdot 10^4$ to $5 \cdot 10^5$.

11. The shaped body of claim 8 wherein the synthetic polymer is a polyethylene glycol.

* * * * *